US006684567B2

(12) United States Patent
Heidrich et al.

(10) Patent No.: US 6,684,567 B2
(45) Date of Patent: Feb. 3, 2004

(54) PLUG DOOR DRIVE SYSTEM

(75) Inventors: Peter Heidrich, Niles, IL (US); Paul A. Skalak, Westchester, IL (US); Robert L. Oakley, Chicago, IL (US)

(73) Assignee: Westinghouse Air Brake Tecnologies Corporation, Wilmerding, PA (US)

( * ) Notice: Subject to any disclaimer, the term of this patent is extended or adjusted under 35 U.S.C. 154(b) by 0 days.

(21) Appl. No.: 10/029,629

(22) Filed: Dec. 18, 2001

(65) Prior Publication Data

US 2003/0110700 A1 Jun. 19, 2003

(51) Int. Cl.[7] ..... E05D 15/10
(52) U.S. Cl. ..... 49/213
(58) Field of Search ..... 49/116, 118, 122, 49/209, 210, 211, 213, 214, 215, 216; 296/155

(56) References Cited

U.S. PATENT DOCUMENTS 4,152,872 A * 5/1979 Tanizaki et al. ..... 49/214
4,503,638 A 3/1985 Schindehutte
5,263,280 A 11/1993 Dilcher
5,893,236 A * 4/1999 Krbec et al. ..... 49/118

* cited by examiner

*Primary Examiner*—Jerry Redman
(74) *Attorney, Agent, or Firm*—James Ray & Associates

(57) ABSTRACT

Drive system for moving a load along a curved path. The drive system includes a base for mounting the drive system, the base having a curved track for guiding the load along the curved path. There is a load engaging mechanism mounted on the base for movement relative to the base, the load engaging mechanism being for moving the load. The load engaging mechanism has a curved track engaging roller for engaging the curved track. A linear drive mechanism including a linearly driven member is mounted on the base. The linearly driven member includes a driving pivot. A drive link is attached to the driving pivot at a drive force receiving end of the drive link, the drive link including a driven pivot at a drive force communicating end of the drive link. The driven pivot is attached to the load engaging mechanism, whereby linear motion of the driving pivot causes motion of the load along the curved path.

18 Claims, 5 Drawing Sheets

PLUG DOOR DRIVE SYSTEM

CROSS-REFERENCE TO RELATED APPLICATIONS

The present invention is closely related to patent application titled: Plug Door Drive System, which was filed in the U.S. Patent and Trademark Office on Oct. 13, 2000 and bears Ser. No. 09/687,339, now Pat. No. 6,539,669. The referenced patent application has two inventors in common with the present application and is incorporated herein by reference thereto.

FIELD OF THE INVENTION

The present invention relates, in general, to drive systems for moving a load along a curved track and, more particularly, the invention relates to sliding plug doors for transit type vehicles.

BACKGROUND OF THE INVENTION

Sliding plug doors for transit vehicles require a drive system which can move the doors along curved paths. When such a door is in its closed position, it is substantially flush with the side wall of the vehicle. When it is opened, it initially moves outward and then moves longitudinally, along the wall, outside the vehicle. Such doors, generally, are guided in that curved motion by rollers engaging a curved track.

A drive for such a door system includes a motor connected to a power conversion unit which applies motive power in both the outward and longitudinal directions, so that the door travels along the curved track.

U.S. Pat. No. 5,893,236 Power Operator for Sliding Plug Doors teaches a door drive employing a planetary gear drive. The planetary gear drive is powered by an electric motor connected to the planetary gear drive. The output shaft of the planetary gear drive has a pinion gear which engages a gear on the drive screw which provides the longitudinal motion. The planetary output gear of the planetary gear drive is connected to a plug/unplug lever to provide motion in and out of the wall of the vehicle. When the door is in the closed position and is energized to open the door, power flows to the planetary output gear to move the door out of the wall of the vehicle. Then, as the door moves along the track, power flows to the drive screw which is connected to a door hanger to move the door longitudinally. It is noted that planetary gear drives are quite expensive.

Another approach to driving a plug door is to have a motor connected to power a drive screw which engages a drive nut which moves the door longitudinally. The motor is allowed to rotate due to the reaction torque due to driving the drive screw. Rotation of the motor is used to move the door into and out of the sidewall of the transit vehicle.

Yet another approach to driving a plug door is to have a curved track substantially coplanar with the straight track to move the door first along the curved path and then longitudinally. A drive for this system includes a motor indirectly connected to linear drive members through a set of well known spur gears. A drive pivot connected to a drive link design requires only the linear input and therefore does not require the use of a planetary gear.

The above applications utilize an electric motor as a primary drive mover. Generally electric prime movers requires a more precise control circuit for door motion control. It is noted that such a control circuit can be quite complex.

SUMMARY OF THE INVENTION

In one aspect, the present invention is a drive system for moving a load along a curved path. The drive system includes a base for mounting the drive system, the base having a curved track for guiding the load along the curved path. There is a load engaging mechanism mounted on the base for movement relative to the base for moving the load. This load engaging mechanism having a curved track engaging roller for engaging the curved track. A linear drive mechanism including a linearly driven member is mounted on the base. The linearly driven member includes a driving pivot. A drive link is attached to the driving pivot at a drive force receiving end of the drive link, the drive link including a driven pivot at a drive force communicating end of the drive link. The driven pivot is attached to the load engaging mechanism, whereby linear motion of the driving pivot causes motion of the load along the curved path.

In another aspect, the invention is a drive system for a plug door of a vehicle having a sidewall. The drive system moves the plug door along a curved path between a closed position substantially within the sidewall of the vehicle and an open position adjacent the sidewall of the vehicle. The drive system has a base for attachment to the vehicle and a carriage mounted on the base for movement in a transverse direction relative to the sidewall. There is at least one elongated support member mounted on the carriage substantially parallel to the sidewall. One or more hangers for supporting the plug doors are mounted on the elongated support member for movement thereon. A curved track is either mounted on the base or formed as a portion of the base. A curved track engaging roller is mounted on the hanger, the curved track engaging roller engaging the curved track. The drive system further includes a linear drive mechanism including a linearly driven member, the linearly driven member including a driving pivot. A drive link is attached to the driving pivot at a drive force receiving end of the drive link, the drive link having a driven pivot at a drive force communicating end of the drive link. The driven pivot is attached to the hanger, so that linear motion of the driving pivot causes motion of the door along the curved path so that the plug door moves between the closed position substantially within the sidewall of the vehicle and the open position adjacent the sidewall of the vehicle.

In another aspect, the invention is a drive system for a pair of biparting plug doors consisting of a first door and a second door. The biparting plug doors are for a vehicle having a sidewall. The drive system moves the first door along a first curved path between a first door closed position substantially within the sidewall of the vehicle and a first door open position adjacent the sidewall of the vehicle. The drive system simultaneously moves the second door between a second door closed position substantially within the sidewall of the vehicle and a second door open position adjacent the sidewall of the vehicle. The drive system includes a base for attachment to the vehicle and a carriage mounted on the base for movement in a transverse direction relative to the sidewall. There are also a first elongated support member and a second elongated support member mounted on the carriage substantially parallel to the sidewall. A first hanger for supporting the first door is mounted on the first elongated support member for movement thereon and a second hanger for supporting the second door is mounted on the second elongated support member for movement thereon. A curved track is either mounted on the base or formed as a portion of the base. A first curved track engaging roller is mounted on the first hanger, the first curved track engaging roller engaging the curved track. There is also a first linear drive mechanism including a first linearly driven member, the first linearly driven member including a first driving pivot. A first drive link is attached to the first driving pivot at a drive force receiving end of the first drive link, the first drive link having a first driven pivot at a drive force communicating end of the first drive link. The first driven pivot is attached to the first hanger so that linear motion of the first driving pivot causes motion of the first door along the first curved path, causing the first door to move between the first door closed position substantially within the sidewall of the vehicle and the first door open position adjacent the sidewall of the vehicle. There is also a second linear drive mechanism including a second linearly driven member, the second linearly driven member including a second driving pivot. A second drive link is attached to the second driving pivot at a drive force receiving end of the second drive link, the second drive link having a second driven pivot at a drive force communicating end of the second drive link. The second driven pivot is attached to the second hanger so that linear motion of the second driving pivot causes motion of the second door along the second curved path, causing the second door to move between the second door closed position substantially within the sidewall of the vehicle and the second door open position adjacent the sidewall of the vehicle.

OBJECTS OF THE INVENTION

It is, therefore, one of the primary objects of the present invention to provide a drive system for moving a load along a curved path.

Another object of the present invention is to provide a relatively simple and inexpensive drive system for moving a load along a curved path.

Still another object of the present invention is to provide a drive system for moving a load along a curved path which is highly reliable.

Yet another object of the present invention is to provide a drive system for a plug door in a sidewall of a vehicle, the drive system moving the door out of the sidewall and then along the sidewall of the vehicle.

A further object of the present invention is to provide a powered plug door for a vehicle which does not require a planetary gear drive.

It is an additional object of the present invention to provide a powered plug door for a vehicle which does not require the use of reaction torque on the motor.

Still yet another object of the present invention is to provide a plug door drive system in which outward and longitudinal movement is enabled by a linear drive mechanism and a simple pivoted link.

Yet still another object of the present invention is to provide a plug door drive system in which outward and longitudinal movement is enabled by a linear drive mechanism and a simple pivoted link, the link also serving as an overcenter lock.

A still further object of the present invention is to provide a plug door drive system having a drive screw in which bending moments in the drive screw are minimized.

An additional object of the present invention is to provide a drive system for biparting plug doors which employs linear drive mechanisms and simple pivoted links to provide outward and longitudinal movement of the doors.

Another object of the present invention is to provide a drive system for biparting plug doors which employs drive screws and simple pivoted links to provide outward and longitudinal movement of the doors.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

Figure 1:
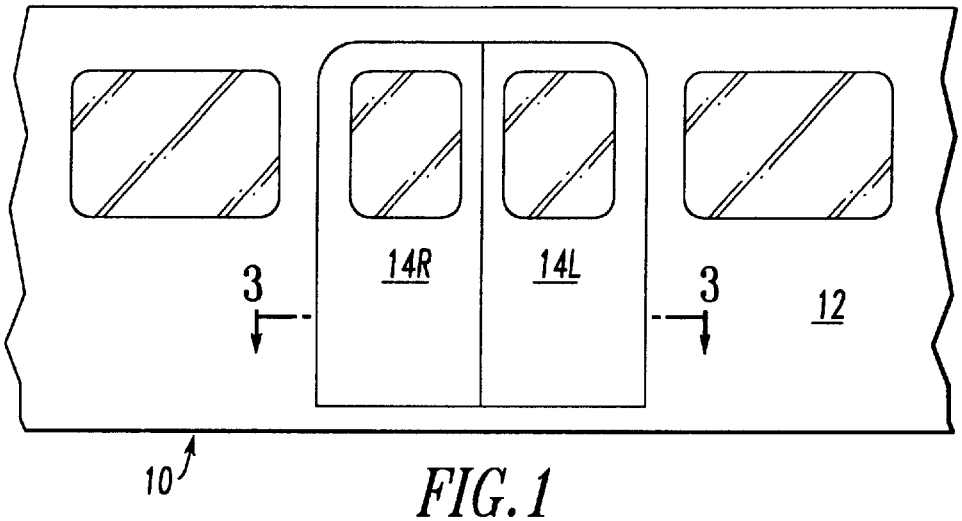
FIG. 1 is an elevation view from outside of a transit vehicle having plug doors which are in their closed positions.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures for the sake of clarity and understanding of the invention.

In applications where the requirements are not specified it may be desirable to utilize a pneumatic drive mover.

Attention is now directed to FIGS. 1 through 4 which illustrate the application to which the presently preferred embodiment of the invention is directed.

Figure 2:
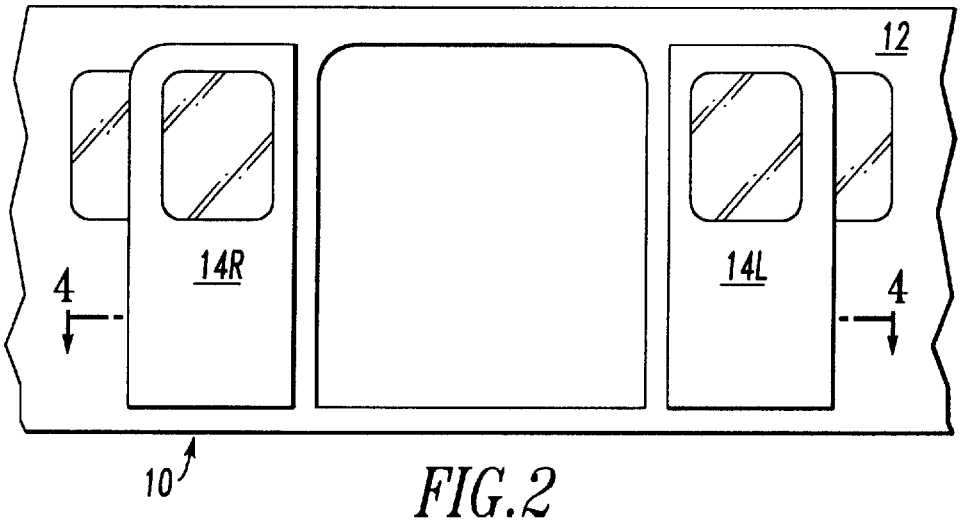
FIG. 2 is an outside elevation view of a portion of a transit vehicle having plug doors which are in their opened positions.

FIGS. 1 and 2 are elevation drawings of a transit vehicle, generally designated 10, having a sidewall 12 and plug doors 14L and 14R. FIG. 1 shows the plug doors 14L and 14R in closed positions and FIG. 2 shows the plug doors 14L and 14R in open positions, adjacent sidewall 12 of transit vehicle 10. The convention employed for labeling the doors is that left door 14L and right door 14R are defined as seen from inside the vehicle 10.

Figure 3:
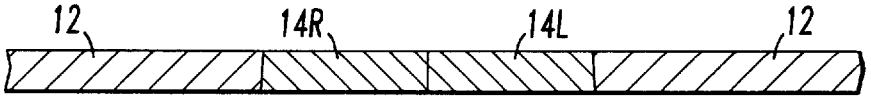
FIG. 3 is a horizontal section taken along line 3—3 in FIG. 1 showing the doors in their closed positions within the sidewall of the vehicle.
Figure 4:
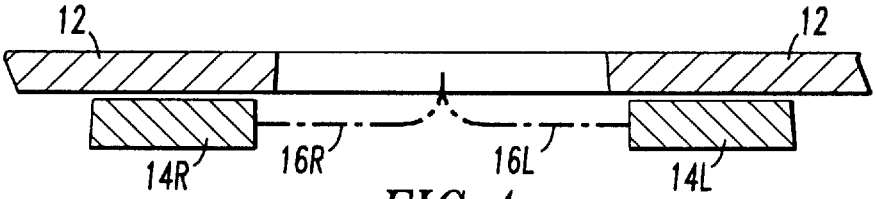
FIG. 4 is a horizontal section taken along line 4—4 in FIG. 2 showing curved paths on which the doors move between closed and open positions.

FIG. 3 is a horizontal section taken along line 3—3 in FIG. 1 which shows doors 14L and 14R in closed positions substantially within sidewall 12 of transit vehicle 10. FIG. 4 is a horizontal section cut along line 4—4 in FIG. 2 which illustrates the doors 14L and 14R in opened positions adjacent sidewall 12. FIG. 4 shows curved path 16L along which door 14L moves between its closed position in FIG. 3 and its open position in FIG. 4. FIG. 4 also shows curved path 16R along which door 14R moves between its closed position in FIG. 3 and its open position in FIG. 4.

Figure 5:
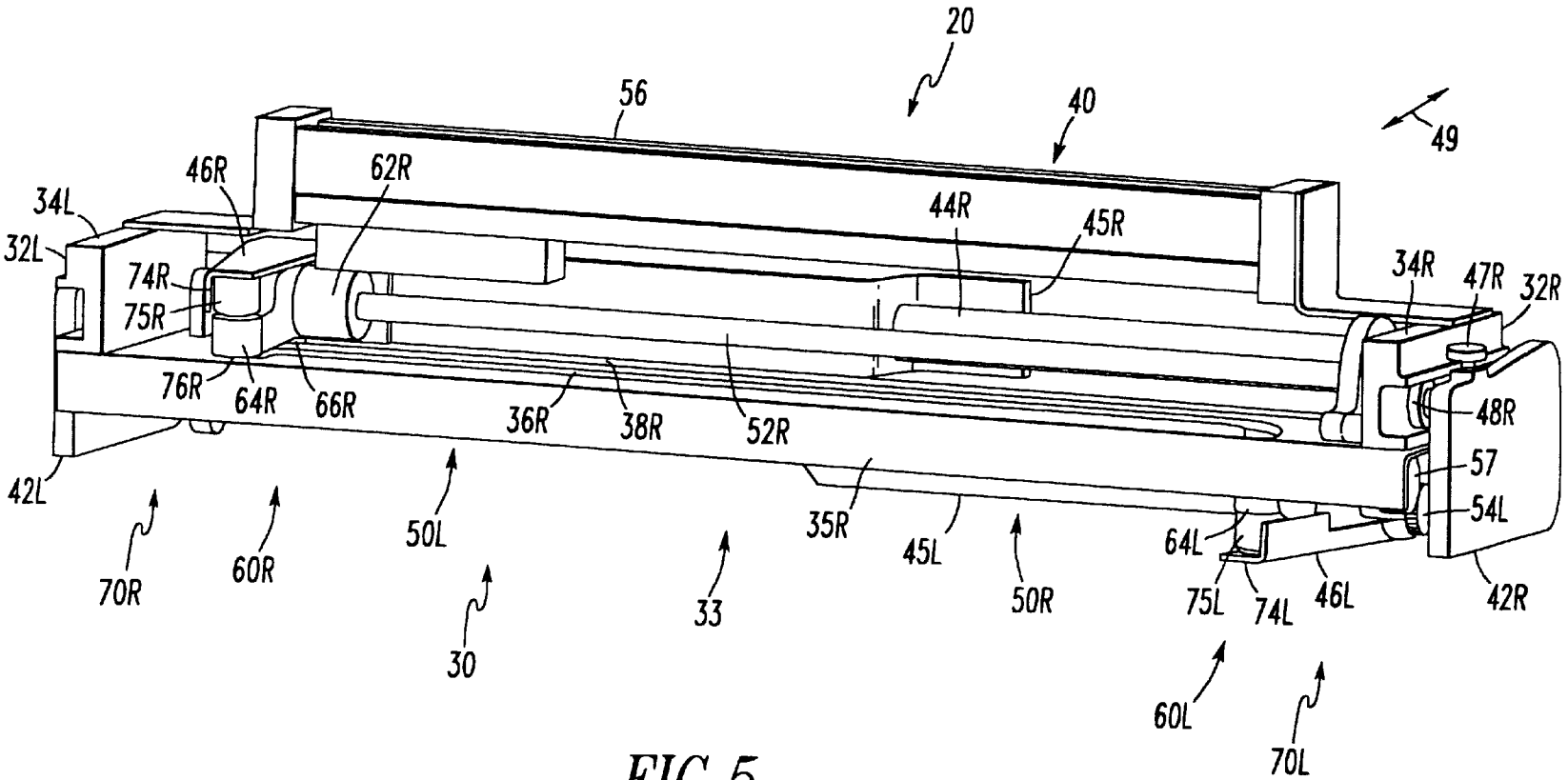
FIG. 5 is a perspective drawing of a door drive system for biparting plug doors which are positioned so that the doors would be closed, the drive system being viewed from inside the vehicle.
Figure 6:
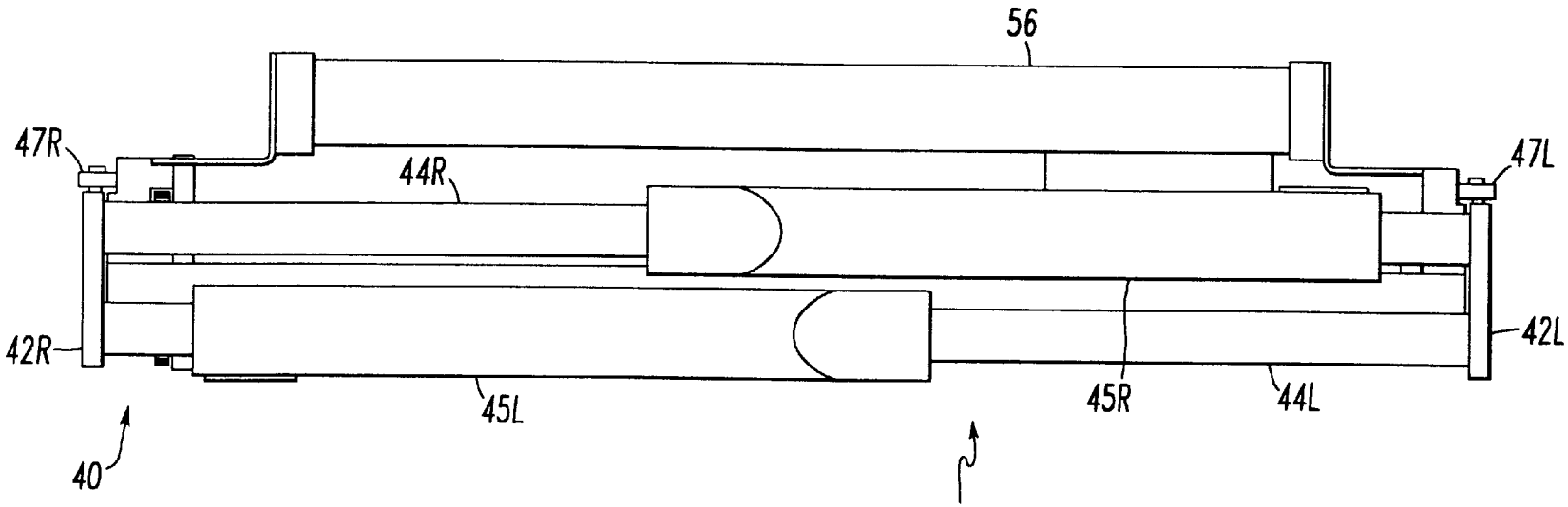
FIG. 6 is an elevation view of the door drive system from outside the vehicle, the system positioned so that the doors would be closed.
Figure 7:
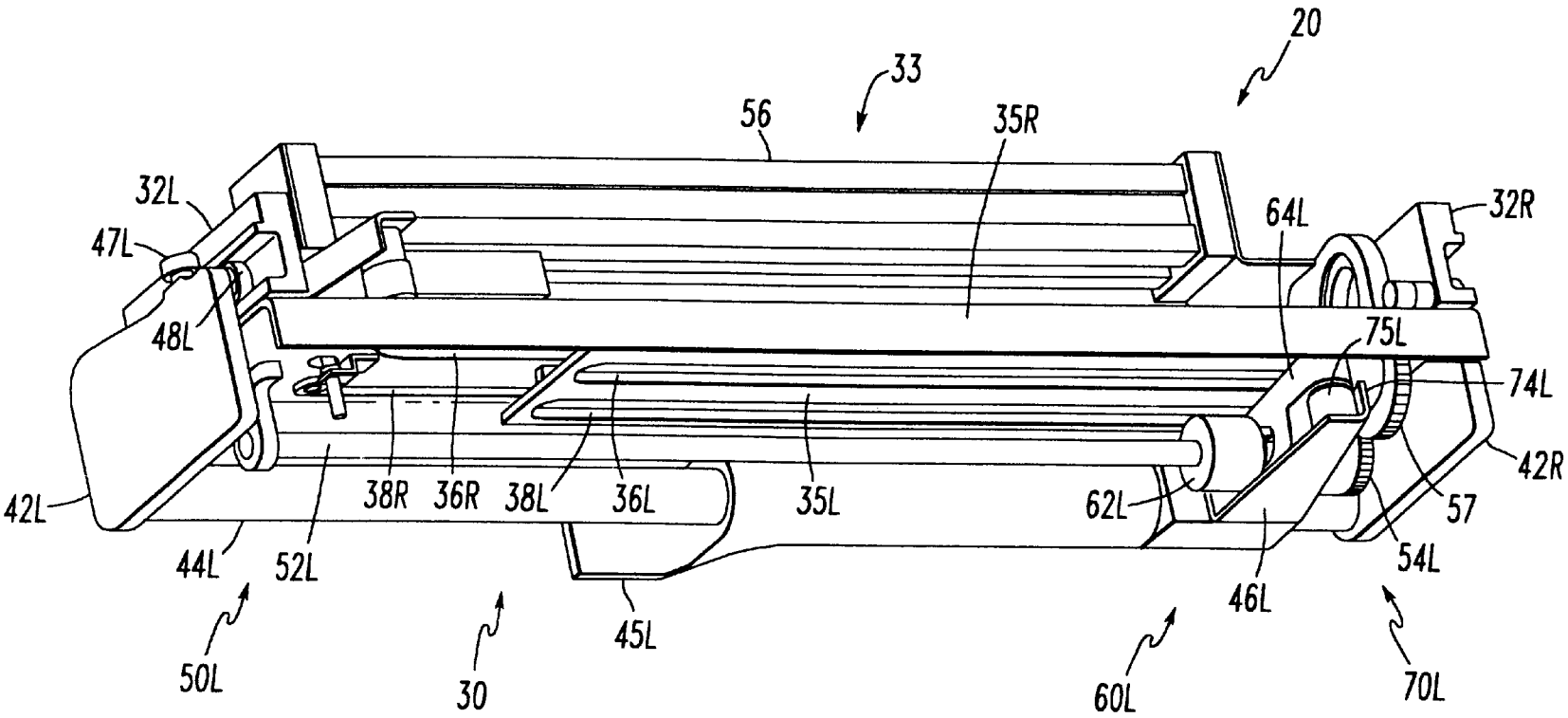
FIG. 7 is a perspective drawing of the door drive system of FIG. 5 when the doors are closed, the system being viewed from inside the vehicle.

The invention is a drive system, generally designated 20, for moving a load such as door 14L or 14R along a curved path such as 16L or 16R. In the presently preferred embodiment of the invention, such drive system 20 moves plug doors 14L and 14R in a transit vehicle 10. FIGS. 5 through 7 illustrate the presently preferred embodiment of drive system 20.

The drive system 20 includes a base, generally designated 30. Base 30 includes, in the presently preferred embodiment, a left channel member 32L and right channel member 32R. Left channel member 32L has mounting surface 34L and right channel member 32R has mounting surface 34R for attachment to transit vehicle 10. Base 30, preferably, has a substantially planar portion, generally designated 33. Portion 33 includes a substantially planar upper portion, generally designated 35R having curved track 36R and straight track 38R. In the presently preferred embodiment, shown in the figures, tracks 36R and 38R are slots cut in substantially planar upper portion 35R of portion 33 of base 30. Portion 33 also includes a substantially planar lower portion 35L having curved track 36L and straight track 38L which is best shown in FIG. 7. In the presently preferred embodiment, shown in the figures, tracks 36L and 38L are slots cut in substantially planar lower portion 35L of portion 33 of base 30. Furthermore, such track 36R is generally symmetrical with the track 36L and track 38R is generally symmetrical with the track 38L.

A carriage 40 is mounted on base 30 to be reciprocally moveable in a transverse direction 49. Carriage 40 includes a left side plate 42L having at least two rollers 48L and at least one roller 47L, which is best shown in FIGS. 6 and 7, and right side plate 42R having at least two rollers 48R and at least one roller 47R. Left side plate 42L and right side plate 42R are connected by elongate support member 44L and elongate support member 44R, which are best shown in FIG. 6.

Load engaging mechanisms, preferably, hangers 45L and 45R are mounted on support members 44L and 44R, respectively. Hanger 45L is for attachment to left door 14L and hanger 45R is for attachment to right door 14R. Elongated support member 44R is mounted above elongated support member 44L. These members, preferably, are polished rods. Following practice known to persons skilled in the art, linear bearings (not shown) are, preferably, included in hangers 45L and 45R.

At least one pneumatic driver 56 is mounted on base 30 and is attached to drive nut 62R. In the preferred embodiment pneumatic driver is a rodless type cylinder design. Linear drive mechanisms, generally designated 50L and 50R, are mounted on base 30. The linear drives 50L and 50R can either include a drive screw or a drive belt. In the preferred embodiment, linear drives 50L and 50R include a screw drive. Linear drive mechanism 50R is best seen in FIG. 5 and linear drive mechanism 50L is best seen in FIG. 7.

Linear drive mechanism 50R includes a drive screw 52R having gear (not shown) mounted at one end. Such gear engages idler gear 57, which, in turn, engages gear 54L.

Figure 8:
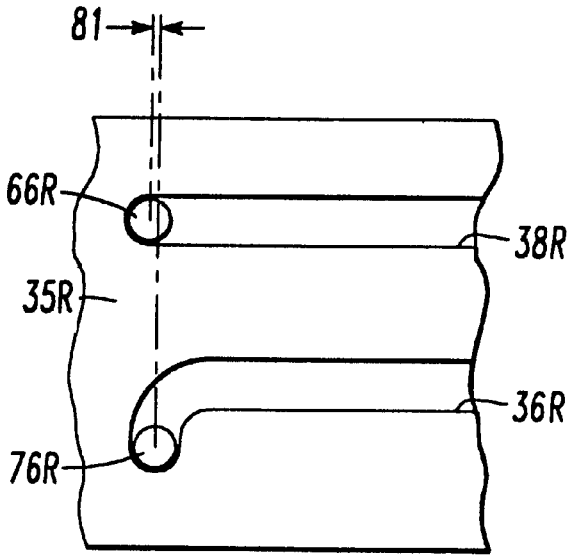
FIG. 8 is a view showing portions of the curved and straight tracks and rollers engaging these for the right door.

Linear drive mechanism 50R further includes a linearly driven member, generally designated 60R. Linearly driven member 60R includes a drive nut 62R mounted on the drive screw 52R for reciprocal motion along such drive screw 52R on rotation thereof. Linear drive mechanism 50R further includes a driving pivot 64R attached to drive nut 62R. Preferably, linearly driven member 60R further includes a straight track engaging roller 66R, which is shown in FIGS. 5 and 8. Straight track engaging roller 66R is for reacting forces perpendicular to drive screw 52R, to reduce bending moments in drive screw 52R.

A drive link for the right door, generally designated 70R, is attached to driving pivot 64R at a drive force receiving end 72R of drive link 70R. A driven pivot 75R is mounted on drive force communicating end 74R of drive link 70R. Preferably, a curved track engaging roller 76R, best seen in FIG. 8, is coaxial with driven pivot 75R. Driven pivot 75R, preferably, is attached to drive bracket 46R, which is attached to hanger 45R, which is for right door 14R. The curved track engaging roller 76R cooperates with curved track 36R to cause right door 14R to follow the curved path 16R shown in FIG. 4. Drive bracket 46R provides an offset between driven pivot 75R and right hanger 45R.

Linear drive mechanism 50L, best seen in FIG. 7, includes a drive screw 52L rotated by gear 54L that is engaged with gear 57, which, in turn, is driven by gear 54R. The linear drive mechanism 50L is generally symmetrical with the linear drive mechanism 50R and is, preferably, mounted below it.

Figure 9:
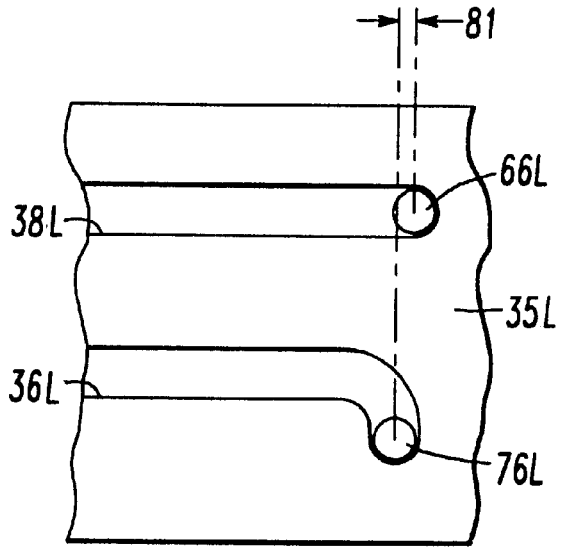
FIG. 9 is a view showing portions of the curved and straight tracks and rollers engaging these for the left door.

Linear drive mechanism 50L includes a linearly driven member, generally designated 60L. Linearly driven member 60L includes a drive nut 62L and a driving pivot 64L attached to drive nut 62L. Driving pivot 64L is best seen in FIG. 7. Preferably, such linearly driven member 60L further includes a straight track engaging roller 66L, which is shown in FIG. 9. Straight track engaging roller 66L is for reacting forces perpendicular to drive screw 52L, to reduce bending moments in drive screw 52L.

A drive link for the left door, generally designated 70L, is attached to driving pivot 64L at a drive force receiving end 72L of drive link 70L. A driven pivot 75L is mounted on drive force communicating end 74L of drive link 70L. Preferably, a curved track engaging roller 76L, best seen in FIG. 9, is coaxial with driven pivot 75L. Driven pivot 75L, preferably, is attached to drive bracket 46L, which is attached to hanger 45L, which supports left door 14L. The curved track engaging roller 76L cooperates with curved track 36 to cause left door 14L to follow the curved path 16L shown in FIG. 4. Drive bracket 46L provides an offset between driven pivot 75L and left hanger 45L.

It is noted that FIGS. 5, 6 and 7 show various portions of the drive system 20 with the doors 14L and 14R closed. A person skilled in the art will recognize that when drive links 70L and 70R are rotated to positions substantially perpendicular to drive screws 52L and 52R, as shown in FIGS. 6 and 7, the mechanical advantage of the links 70L and 70R increases greatly, which provides large forces for closing the doors 14L and 14R, and for compressing door seals (not shown).

It is presently preferred, with particular reference being made to FIG. 8, that straight track 38R be extended a distance 81 past the left end of curved track 36R so that an overcenter lock is provided. It is also presently preferred, with particular reference being made to FIG. 9, that straight track 38L be extended a distance 81 past the right end of curved track 36L so that a second overcenter lock is provided.

It is preferred that curved track 36R and straight track 38R be substantially coplanar. It is further preferred that curved track 36L and straight track 38L be substantially coplanar. Preferably, they are slots formed in substantially planar portions 35R and 35L of base 30, as shown in FIGS. 8 and 9.

While a presently preferred embodiment of the instant invention, which is a transit vehicle plug door system, has been described in detail above in accordance the patent statutes, it should be recognized that various other modifications and adaptations of the invention may be made by those persons who are skilled in the relevant art without departing from either the spirit of the invention or the scope of the appended claims.

We claim:

1. A drive system for moving a load along a curved path, said drive system comprising:

a base for mounting said drive system, said base having a curved track for guiding said load along said curved path;

a load engaging mechanism mounted on said base for movement relative to said base, said load engaging mechanism moving said load, said load engaging mechanism having a curved track engaging roller for engaging said curved track;

a linear drive mechanism mounted on said base, said linear drive mechanism including a linearly driven member, a driving pivot, a pneumatic cylinder, a drive nut having a linear power connection to said cylinder, at least one of said cylinder and said drive nut being mounted on said base, said drive nut engaging a drive screw to be driven thereby, whereby said linear motion of said drive nut imparts rotation motion on said drive screw and hence said driving pivot; and a drive link attached to said driving pivot at a drive force receiving end of said drive link, said drive link including a driven pivot at a drive force communicating end of said drive link, said driven pivot being attached to said load engaging mechanism, whereby linear motion of said driving pivot causes motion of such load along such curved path.

2. A drive system, according to claim 1, wherein said base further includes a substantially straight track, said substantially straight track being substantially parallel to said drive screw, said linearly driven member further including a straight track engaging roller engaging said substantially straight track to react forces transverse to said drive screw whereby bending moments on said drive screw are reduced.

3. A drive system, according to claim 2, wherein said substantially straight track is substantially coplanar with said curved track.

4. A drive system, according to claim 3, wherein said substantially straight track is a substantially straight slot in a substantially planar portion of said base.

5. A drive system for a plug door of a vehicle having a sidewall, said drive system for moving said plug door along a curved path between a closed position substantially within said sidewall of said vehicle and an open position adjacent said sidewall of said vehicle, said drive system comprising:

a base for attachment to said vehicle;

a carriage mounted on said base for movement in a transverse direction relative to said sidewall;

at lest one elongated support member mounted on said carriage, said elongated support member being substantially parallel to said sidewall;

at least one hanger for supporting said plug door, said hanger mounted on said elongated support member for movement thereon;

a curved track one of mounted on said base and formed as a portion of said base;

a curved track engaging roller mounted on said hanger, said curved track engaging roller engaging said curved track;

a linear drive mechanism including a linearly driven member, a driving pivot, a pneumatic cylinder, a drive nut having a linear power connection to said cylinder, said drive nut engaging a drive screw to be driven thereby, whereby said linear motion of said drive nut imparts rotation motion on said drive screw and hence said driving pivot; and a drive link attached to said driving pivot at a drive force receiving end of said drive link, said drive link having a driven pivot at a drive force communicating end of said drive link, said driven pivot being attached to said hanger, whereby linear motion of said driving pivot causes motion of said door along said curved path, whereby plug door moves between said closed position substantially within said sidewall of said vehicle and said open position adjacent said sidewall of said vehicle.

6. A drive system, according to claim 5, further including a substantially straight track, said substantially straight track being substantially parallel to said drive screw, said linearly driven member further including a straight track engaging roller engaging said substantially straight track to react forces transverse to said drive screw whereby bending moments on said drive screw are reduced.

7. A drive system, according to claim 6, wherein said substantially straight track is substantially coplanar with said curved track.

8. A drive system, according to claim 7, wherein said substantially straight track is a substantially straight slot in a substantially planar portion of said base of said drive system and said curved track is a curved slot in said substantially planar portion of said base.

9. A drive system, according to claim 6, wherein said substantially straight track is sufficiently long that said link acts as an overcenter lock to lock said door in said closed position.

10. A drive system, according to claim 5, wherein said driven pivot is attached to said hanger by a drive bracket, said drive bracket providing an offset of said driven pivot from said hanger in an inward direction relative to said sidewall of said vehicle.

11. A drive system, according to claim 5, wherein said curved track is so configured that said link provides a high mechanical advantage for forcing said door to said closed position.

12. A drive system, according to claim 5, wherein said base includes, at each end thereof, a channel member oriented in said transverse direction and said carriage includes rollers engaging said channel member to permit said movement in said transverse direction.

13. A drive system, according to claim 5, wherein said rotary power connection includes a pair of meshing gears.

14. A drive system for a pair of biparting plug doors consisting of a first door and a second door, said biparting plug doors for a vehicle having a sidewall, said drive system moving said first door along a first curved path between a first door closed position substantially within said sidewall of said vehicle and a first door open position adjacent said sidewall of said vehicle, said drive system simultaneously moving said second door between a second door closed position substantially within said sidewall of said vehicle and a second door open position adjacent said sidewall of said vehicle, said drive system comprising:

a base for attachment to said vehicle;

a carriage mounted on said base for movement in a transverse direction relative to said sidewall;

a first elongated support member mounted on said carriage, said first elongated support member being substantially parallel to said sidewall;

a second elongated support member mounted on said carriage, said second elongated support member being substantially parallel to said sidewall;

a first hanger for supporting said first door, said first hanger mounted on said first elongated support member for movement thereon;

a second hanger for supporting said second door, said second hanger mounted on said second elongated support member for movement thereon;

a curved track one of mounted on said base and formed as a portion of said base;

a first curved track engaging roller mounted on said first hanger, said first curved track engaging roller engaging said curved track;

a first linear drive mechanism including a first linearly driven member, a first driving pivot, a pneumatic cylinder, a first drive nut having linear power connection to said cylinder, said drive nut engaging a first drive screw to be driven thereby, whereby said linear motion of said drive nut imparts rotation motion on said drive screw and hence said driving pivot;

a first drive link attached to said first driving pivot at a drive force receiving end of said first drive link, said first drive link having a first driven pivot at a drive force communicating end of said first drive link, said first driven pivot being attached to said first hanger, whereby linear motion of said first driving pivot causes motion of said first door along said first curved path, whereby said first door moves between said first door closed position substantially within said sidewall of said vehicle and said first door open position adjacent said sidewall of said vehicle;

a second linear drive mechanism including a second linearly driven member, said second linearly driven member including a second driving pivot; and a second drive link attached to said second driving pivot at a drive force receiving end of said second drive link, said second drive link having a second driven pivot at a drive force communicating end of said second drive link, said second driven pivot being attached to said second hanger, whereby linear motion of said second driving pivot causes motion of said second door along said second curved path, whereby said second door moves between said second door closed position substantially within said sidewall of said vehicle and said second door open position adjacent said sidewall of said vehicle.

15. A drive system, according to claim 14, wherein said linear drive mechanism further includes:

a second drive screw connected to receive rotary power from said first drive screw; and said second linearly driven member including a second drive nut engaging said second drive screw to be driven thereby, whereby rotation of said second drive screw causes said linear motion of said second drive nut and hence said second driving pivot.

16. A drive system, according to claim 15, wherein said base has a substantially planar portion disposed beneath said first drive screw, said first drive nut and said first drive link, said substantially planar portion further being disposed above said second drive screw, said second drive nut and said second drive link, said curved track being formed as a curved slot in said substantially planar portion of said base.

17. A drive system, according to claim 16, further including:

a straight track formed as a straight slot in said substantially planar portion of said base, said first linearly driven member including a first straight track engaging roller engaging said straight track to react forces transverse to said first drive screw whereby bending moments in said first drive screw are reduced; and said second linearly driven member including a second straight track engaging roller engaging said straight track to react forces transverse to said second drive screw whereby bending moments in said second drive screw are reduced.

18. A drive system, according to claim 17, wherein said straight track is sufficiently long that said first drive link and said second drive link act as overcenter locks to lock said first door and said second door in said closed positions.

* * * * *